US009642510B2

(12) United States Patent
Yoon et al.

(10) Patent No.: US 9,642,510 B2
(45) **Date of Patent: *May 9, 2017**

(54) DISHWASHER AND CONTROL METHOD THEREOF

(75) Inventors: Sangheon Yoon, Seoul (KR); Jaechul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 160 days.

This patent is subject to a terminal disclaimer.

(21) Appl. No.: 13/638,111

(22) PCT Filed: Mar. 25, 2011

(86) PCT No.: PCT/KR2011/002093

§ 371 (c)(1),
(2), (4) Date: Sep. 28, 2012

(87) PCT Pub. No.: WO2011/122804

PCT Pub. Date: Oct. 6, 2011

(65) Prior Publication Data

US 2013/0019899 A1 Jan. 24, 2013

(30) Foreign Application Priority Data

Mar. 31, 2010 (KR) ..... 10-2010-0029027

(51) Int. Cl.
*A47L 15/42* (2006.01)

(52) U.S. Cl.
CPC ..... *A47L 15/4206* (2013.01); *A47L 15/4208* (2013.01)

(58) Field of Classification Search
CPC .... A47L 9/20; A47L 11/4027; A47L 11/4033; A47L 15/4202; A47L 15/4204; A47L 15/4206; A47L 15/4208; D06F 39/10
(Continued)

(56) References Cited

U.S. PATENT DOCUMENTS 3,429,444 A 2/1969 Spiegel et al.
4,217,220 A 8/1980 Egli et al.
(Continued)

FOREIGN PATENT DOCUMENTS

CN 1600257 A 3/2005
CN 101248976 A 8/2008
(Continued)

OTHER PUBLICATIONS

Australian Office Action dated Jun. 14, 2013.
(Continued)

*Primary Examiner* — David Cormier
(74) *Attorney, Agent, or Firm* — KED & Associates LLP

(57) ABSTRACT

The present invention relates to a dishwasher and a control method thereof. According to one aspect, the dishwasher which washes dishes according to washing, rinsing, and drying steps comprises: a tub which is provided with a rack for accommodating dishes, and a washing nozzle for spraying washing water; a sump in which the washing water supplied to the tub is collected; a filter device which is provided to the sump, and allowing foreign substances of the washing water to be filtered; and a cleaning unit which clears away the foreign substances accumulated in the filter device.

8 Claims, 16 Drawing Sheets

(58) Field of Classification Search
USPC ..... 134/56 D, 57 D, 58 D, 110, 111, 104.1, 134/104.2, 104.4
See application file for complete search history.

(56) References Cited

U.S. PATENT DOCUMENTS

| | | | | |
|---|---|---|---|---|
| 5,711,325 | A * | 1/1998 | Kloss et al. | 134/104.1 |
| 8,707,973 | B2 * | 4/2014 | Yoon | A47L 15/4206 134/104.1 |
| 2002/0074026 | A1 | 6/2002 | Kim et al. | |
| 2003/0029478 | A1 | 2/2003 | Hegeman | |
| 2004/0118435 | A1 | 6/2004 | Jung et al. | |
| 2004/0163690 | A1 | 8/2004 | Kim | |
| 2010/0154841 | A1 * | 6/2010 | Fountain et al. | 134/104.2 |
| 2010/0224223 | A1 * | 9/2010 | Kehl et al. | 134/56 D |
| 2011/0126865 | A1 * | 6/2011 | Yoon | A47L 15/4206 134/104.1 |

FOREIGN PATENT DOCUMENTS

| | | | | |
|---|---|---|---|---|
| CN | 101406379 | | 4/2009 | |
| DE | 11 34 489 | B | 8/1962 | |
| DE | 37 45 169 | | 7/1999 | |
| EP | 0 752 231 | | 1/1997 | |
| EP | 0 774 230 | | 5/1997 | |
| EP | 1 649 797 | | 4/2006 | |
| EP | 1 862 104 | | 12/2007 | |
| IT | EP 0752231 | A1 * | 1/1997 | A47L 15/4206 |
| KR | 10-2004-0046942 | A | 6/2004 | |
| KR | 10-2007-0014732 | A | 2/2007 | |
| KR | 10-2007-0078119 | A | 7/2007 | |
| KR | 10-2008-0057398 | A | 6/2008 | |
| KR | 10-2009-0061479 | | 6/2009 | |
| WO | WO 2009/050548 | A2 | 4/2009 | |

OTHER PUBLICATIONS

International Search Report dated Dec. 19, 2011 issued in Application No. PCT/KR2011/002093.
Russian Notice of Allowance dated Dec. 17, 2013.
Chinese Office Action dated May 28, 2014.
European Search Report for Application 11762976.6 dated Mar. 15, 2016.
European Search Report dated Jun. 21, 2016 issued in Application No. 11762976.6.

* cited by examiner

DISHWASHER AND CONTROL METHOD THEREOF

CROSS-REFERENCE TO RELATED PATENT APPLICATIONS

This application is a U.S. National Stage Application under 35 U.S.C. §371 of PCT Application No. PCT/KR2011/002093, filed Mar. 25, 2011, which claims priority to Korean Patent Application No. 10-2010-0029027, filed Mar. 31, 2010.

FIELD OF THE INVENTION

The present invention relates to a dishwasher and method of controlling the same.

BACKGROUND

In general, a dishwasher is an appliance which sprays washing water onto the dishes on which food, garbage, or the like is stained to wash the dishes.

More specifically, according to the dishwasher, clean washing water is supplied to a sump disposed at a side of space for washing, and then a washing water spraying device sprays the washing water to the dishes in the space to thereby wash the dishes. The washing water used to wash the dishes is recovered into the sump and then is supplied again into the washing water spraying device through a filter device disposed in the sump.

When the dishes are washed through the processes described above, the washing water present in the space for washing and the sump is discharged to the outside. Here, foreign substances filtered by the filter device may be discharged together with the washing water to the outside of the dishwasher.

However, in the dishwasher according to the related art, since the foreign substances continuously are accumulated in the filter device during washing of dishes, the filter device may be clogged by the foreign substances.

In addition, since the foreign substances continuously accumulated in the filter device causes flow resistance against the washing water, a flow amount and velocity of the washing water flowing through the filter device may be reduced. As a result, the amount of washing water supplied into the washing water spraying device may be reduced, such that washing performance of the dishwasher may be deteriorated. In addition, a washing water pump unit pumping the washing water may be overloaded.

In addition, when the foreign substances are continuously accumulated in the filter device, the foreign substances may adhere to at least one surface of the filter. Therefore the foreign substances may not be easily removed and a bad smell may be caused in the space for washing due to decay of the foreign substances.

SUMMARY

An object of the present invention is to provide a dishwasher capable of preventing filter device from being clogged by foreign substances and a method of controlling the same.

Another object of the present invention is to provide a dishwasher in which filter device are capable of being cleaned and a method of controlling the same.

According to one aspect, there is provided a dishwasher washing dishes according to washing, rinsing, and drying steps, comprising, a tub which is provided with a rack for accommodating dishes, and a washing nozzle for spraying washing water, a sump in which the washing water supplied to the tub is collected, a filter device provided to the sump, and allowing foreign substances of the washing water to be filtered, and a cleaning unit which clears away the foreign substances accumulated in the filter device.

According to another aspect, there is provided a method of controlling a dishwasher, the dishwasher including a space for washing in which dishes are accommodated, a sump provided so that washing water sprayed into the space for washing is introduced to pass through a filter, a washing pump pumping the washing water introduced from the sump, and a water discharge pump communicated with sump to discharge the washing water in the sump to the outside, the method comprising performing a washing step for washing the dishes, cleaning foreign substances inserted the filter during the washing step, and performing a rinsing step rinsing the dishes after the washing step is ended.

According to the exemplary embodiments of the invention, since filter cleaning is performed in the dish washing step, filters are prevented from being clogged by foreign substances.

Further, since time to clean the filter increases during the washing step in which a large amount of foreign substances is accumulated and decreases during the rinsing step in which the amount of foreign substances is relatively small, the cleaning efficiency may be improved.

Further, since the filter cleaning is continuously or intermittently performed during the washing step to prevent foreign substances to be inserted into the filter, contamination of the filter may be significantly reduced.

Further, since the filter cleaning is performed in the water discharging process during the rinsing step and as a result the foreign substances separated from the filter may be discharged to the outside, a bad smell due to decay of the foreign substances may be prevented.

Further, since the filter cleaning is performed during a short period of time in the rinsing step in which the foreign substances are accumulated in a relatively small amount, power consumption may be reduced.

Therefore, the performance of cleaning dishes is improved and foreign substances are easily discharged, thereby making it possible to increase reliability of a product.

DETAILED DESCRIPTION

Exemplary embodiments of the present invention will now be described in detail with reference to the accompanying drawings. However, it should be noted that the spirit of the present invention is not limited to the exemplary embodiments set forth herein and those skilled in the art who understand the present invention can easily propose other exemplary embodiments within the same spirit.

Figure 1:
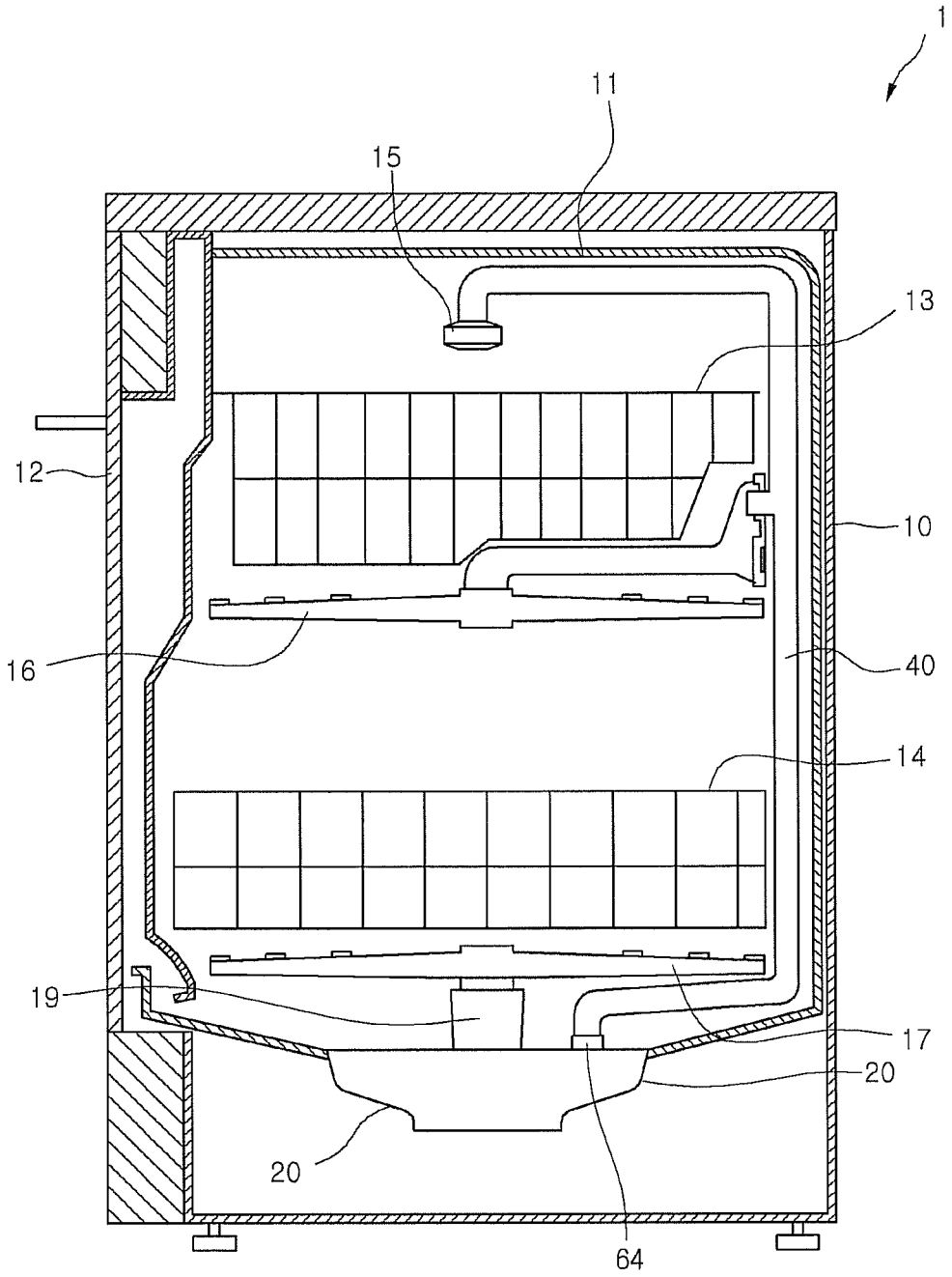
FIG. 1 is a cross sectional view showing a dishwasher according to a first exemplary embodiment of the present invention.
Figure 2:
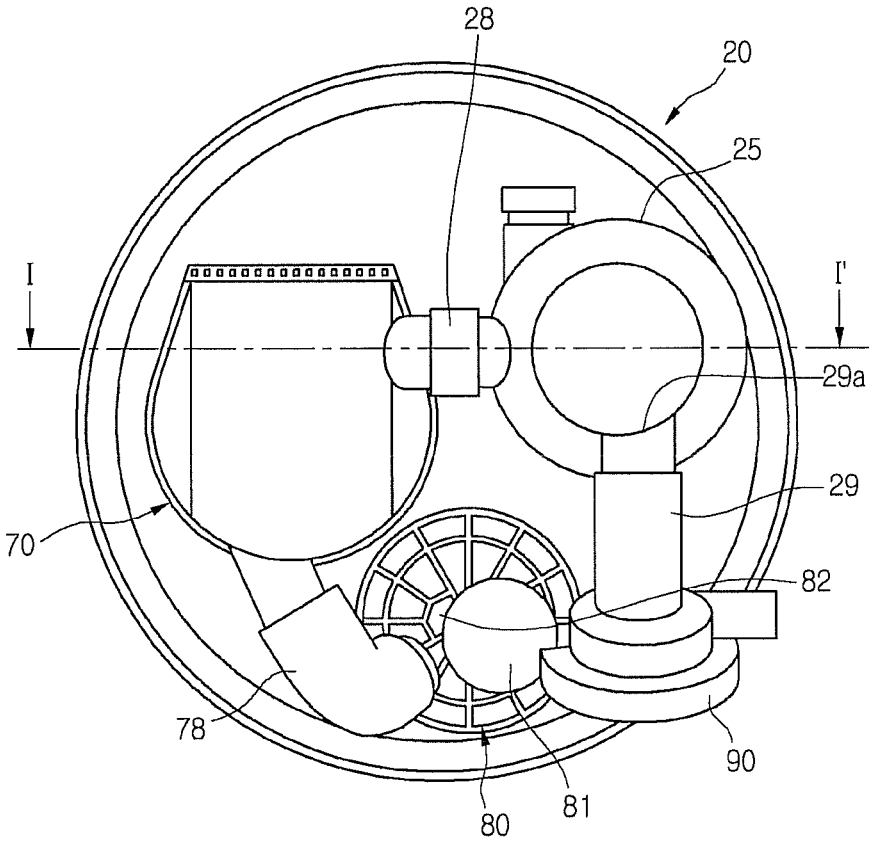
FIG. 2 is a bottom view showing a sump according to the first exemplary embodiment of the present invention.
Figure 3:
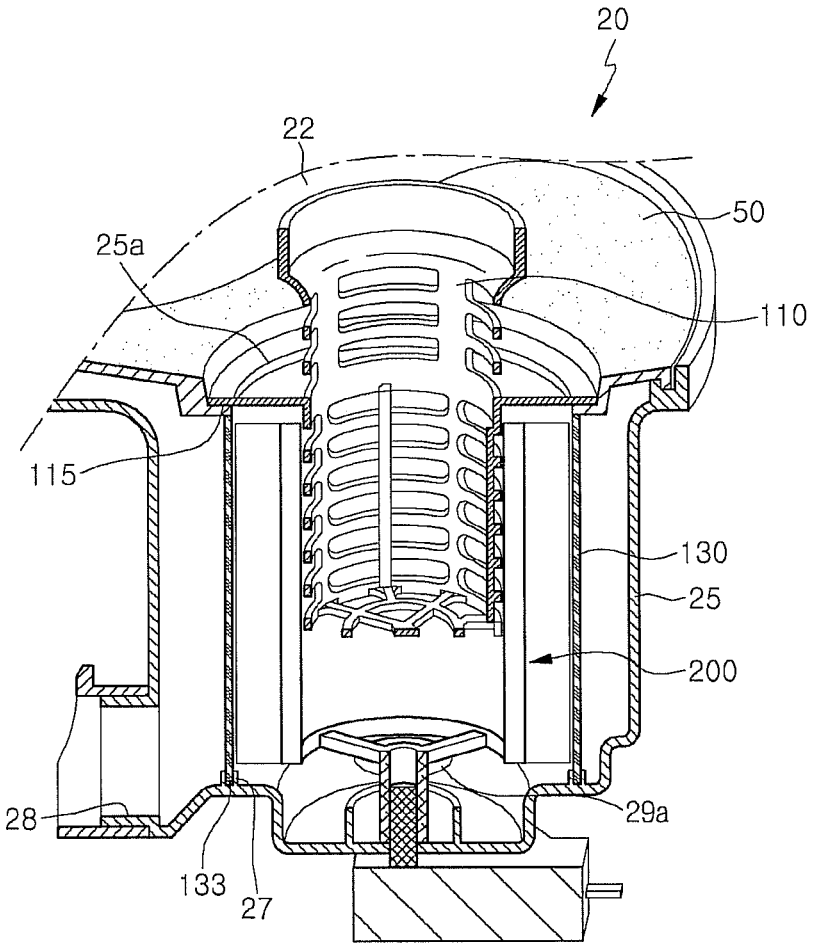
FIG. 3 is a cross sectional view partially showing a configuration of the sump according to the first exemplary embodiment of the present invention.
Figure 4:
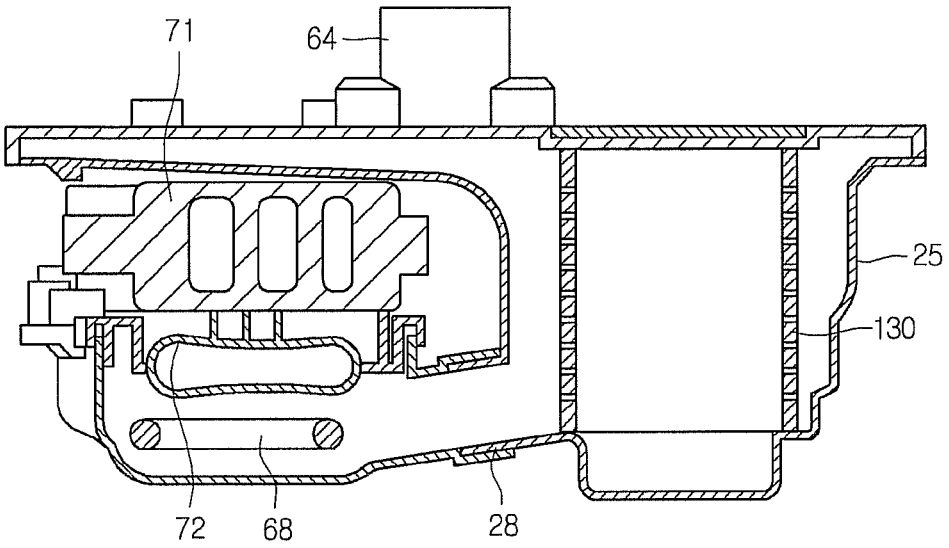
FIG. 4 is a cross sectional view taken along I-I' shown in FIG. 2.

FIG. 1 is a cross sectional view showing a dishwasher according to a first exemplary embodiment of the present invention, FIG. 2 is a bottom view showing a sump according to the first exemplary embodiment of the present invention, FIG. 3 is a cross sectional view partially showing a configuration of the sump according to the first exemplary embodiment of the present invention, and FIG. 4 is a cross sectional view taken along I-I' shown in FIG. 2. In FIG. 4, a first filter 110 is omitted (that is, the first filter 110 is not shown).

Referring to FIGS. 1 to 4, the dishwasher 1 according to the first exemplary embodiment of the present invention is configured to include a case 10 forming an outer appearance thereof, a tub 11 accommodated in the case 10 and forming space for washing, a door 12 formed in the front surface of the tub 11 and opening ad closing the space of washing, and a sump 20 formed in a side of the tub 11 and storing washing water.

Lower and upper racks 14 and 13 which dishes are accommodated are formed within the tub 11. The upper rack 13 is spaced apart from an upper portion of the lower rack 14 at a predetermined distance. In addition, the upper and lower racks 13 and 14 are guided by guide rails (not shown) provided on an inner surface of the tub 11, thereby making it possible to be drawn out through the front of the tub 11.

In the inner portion of the tub 11, a lower nozzle 17, an upper nozzle 16, and a top nozzle 15 are provided so as to spray washing water supplied from the sump 20 into the inner portion of the space for washing. The above-mentioned nozzles may be collectively referred to as a washing nozzle.

More specifically, the lower nozzle 17 is coupled to an upper side of the sump 20 to spray washing water toward the lower rack 14 or the sump 20. Also, a lower nozzle coupling part 19 coupled to the lower nozzle 17 is provided in the sump 20.

The upper nozzle 16 is positioned at a central portion of the space for washing to spray washing water toward the upper rack 13, and the top nozzle 15 is positioned at a ceiling of the tub 11 to spray washing water downward.

A washing water guide 40 moving washing water supplied from a washing pump 70 is provided in the inner portion of the tub 11. Also, a guide coupling part 64 coupled to the washing water guide 40 is provided in the sump 20.

The washing water which is moved through the washing water guide 40 may be sprayed toward the upper rack 13 through the top nozzle 15 and the upper nozzle 16.

The washing water which has cleaned dishes in the tub 11 is introduced into the sump 20. The sump 20 includes filter device 110 and 130 filtering foreign substances from the washing water, a washing pump 70 pumping the washing water filtered through the filter device 110 and 130, and a flow path controlling part 80 controlling a flow path so as to flow the washing water passing through the washing pump 70 to the lower nozzle 17 or the washing water guide 40.

More specifically, the filter device 110 and 130 includes a plurality of filters. The plurality of filters includes, for example, a first filter 110 filtering foreign substances having a relatively large volume from the washing water introduced from the tub 11 and a second filter 130 provided at an outer side of the first filter 110 and filtering foreign substances having a relatively small volume (foreign substances that are not filtered by the first filter) from the washing water.

The sump 20 includes a filter housing 25 receiving the filter device 110 and 130. The filter housing 25 has a downwardly recessed shape and defines a filter chamber for providing space in which the filter device 110 and 130 are received.

A filter inflow part 25*a* which allows the washing water to flow into the filter device 110 and 130 is disposed at an upper portion of the filter housing 25. The washing water is introduced into the filter housing 26 through the filter inflow part 25*a*. Foreign substances of the washing water are filtered through the first and second filters 110 and 130.

A pump inflow part 28 which allows the filtered washing water to flow into the washing pump 70 is provided at a side of the lower portion of the filter housing 25. The pump inflow part 28 extends to the outside of the filter housing 25.

The washing water stored in the sump 20 may flow into the pump inflow part 28 through the filter device 110 and 130 by a suction force (pumping force) of the washing pump 70.

The washing pump 70 includes a washing motor 71 providing a driving force and an impeller part 72 which is rotated by a driving force of the washing motor 71. In addition, a pump discharge part 78 discharging the washing water from the washing pump 70 is provided at a side of the washing pump 70.

The washing water is introduced into the impeller part 72 through the pump inflow part 28, and discharged through the pump discharge part 78 by way of the impeller part 72.

In addition, a heater 68 heating the washing water during flow of the washing water is provided at a side of the washing pump 80. For example, the heater 68 may be positioned upstream of the washing pump 80. Since the washing water is able to clean dishes in a state in which it is heated to a high temperature by the heater 68, cleaning efficiency may be increased.

The flow path controlling part 80 is coupled to the pump discharge part 78. The flow path controlling part 80 includes a control valve 82 controlling the flow path of the washing water and a valve drive part 81 driving the control valve 82.

The washing water introduced into the flow path controlling part 80 may flow to a lower nozzle coupling part 19 or a guide coupling part 64 by the control valve 82.

That is, when the washing water is to flow into the lower nozzle 17, the washing water may move to the lower nozzle coupling part 19 by operation of the control valve 82, and when the washing water is to flow into the upper nozzle 16 or the top nozzle 15, the washing water may move to the guide coupling part 64.

In addition, the washing water guide 40 may include separate flow paths each communicated with the top nozzle 15 and the upper nozzle 16, for example, a top nozzle flow path (not shown) and an upper nozzle flow path (not shown), and the washing water may move to the top nozzle flow path or the upper nozzle flow path. Further, the washing water guide 40 may include a single flow path, and, according to the intensity of the pumping force, the washing water may flow only to the upper nozzle 16 or to the upper nozzle 16 and the top nozzle 15.

The top nozzle 15, the upper nozzle 16, and the lower nozzle 17 may be selectively opened so as to spray the washing water through some of the nozzles 15, 16, and 17. Alternatively, all of the nozzles 15, 16, and 17 may be opened so as to spray the washing water through all nozzles 15, 16, and 17.

A water discharge pump 90 generating a suction force to discharge the washing water and a water discharge part 29 provided between the filter device 110 and 130 and the water discharge pump 90 to discharge the washing water and foreign substances are provided at a side of the filter device 110 and 130. The discharge part 29 extends to the outside of the filter hosing in a different direction than that of the pump inflow part 28.

When the discharge pump 90 is driven, the washing water stored in the sump 20 may be discharged together with foreign substances remaining in the inner portion of the filter device 110 and 130 through the discharge part 29 and the discharge pump 90.

Referring to FIG. 3, the structure of the sump 20 will be described in detail.

The sump 20 includes a sump cover 22 forming a top surface of the sump 20, a filter housing 25 provided under the sump cover 22 to receive the filter device 110 and 130, and a pre filter 50 provided on the sump cover 22 to primarily filter the washing water. The washing water passing through the pre filter 50 may flow into the filter device 110 and 130.

The pre filter 50 may be referred to as "a third filter" in order to distinguish the pre filter 50 from the first and second filter device 110 and 130.

A discharge hole 29*a* discharging the washing water into the discharge part 29 is formed in the filter housing 25. The washing water in the filter housing 25 may be discharged through the discharge hole 20*a* and introduced into the water discharge pump 90 through the water discharge part 29.

Meanwhile, the first filter 110 is supported by the upper portion of the sump 20 and extends to the inner portion of the filter device 130. The first filter 110 includes a seat part 115 allowing the first filter 110 to be seated on the upper portion of the sump 20.

The second filter 130 includes a lower end 133 coupled to the filter housing 25 at a lower portion thereof. The lower end 133 may be coupled to a filter coupling part 27 provided at the lower portion of the filter housing 25.

A cleaning unit 200 contacting the second filter 130 to clean away foreign substances accumulated in the filter device 130 may be provided at an inner side of the second filter 130.

A washing step according to the structure of the dishwasher of the exemplary embodiment of the present invention will be simply described.

The washing water is supplied from the outside and stored in the sump 20. In addition, when the washing pump 70 is driven, the washing water may be simultaneously or selectively sprayed onto the top nozzle 15, the upper nozzle 16, and the lower nozzle 17 through the washing pump 70 and the flow path control part 80.

The sprayed washing water may clean dishes accommodated in the racks 13 and 14 and then stored again in the sump 20. Foreign substances of the washing water may be filtered through the filter device 110 and 130 by the suction force of the washing pump 70.

After cleaning, the cleaned washing water may be sprayed again into the space for washing of the tub 11 through the washing pump 70 and the flow path control part 80. The above-mentioned washing step may be repeated several times.

Figure 5:
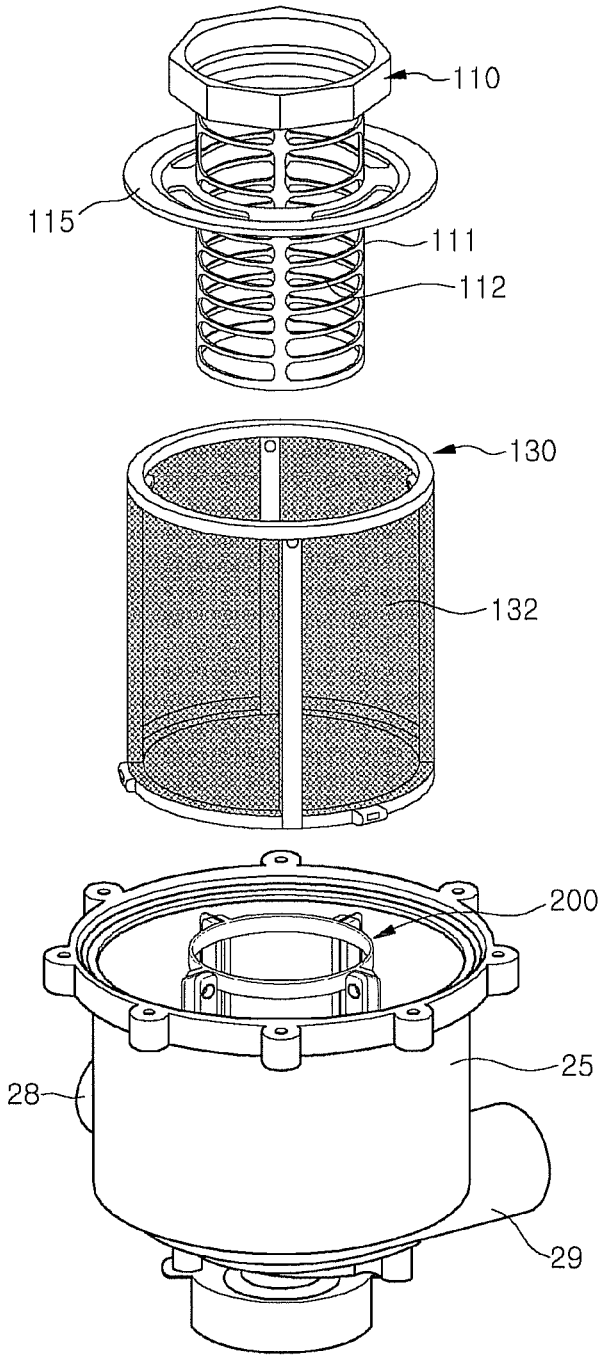
FIG. 5 is an exploded perspective view showing configurations of a filter device and a cleaning unit according to the first exemplary embodiment of the present invention.
Figure 6:
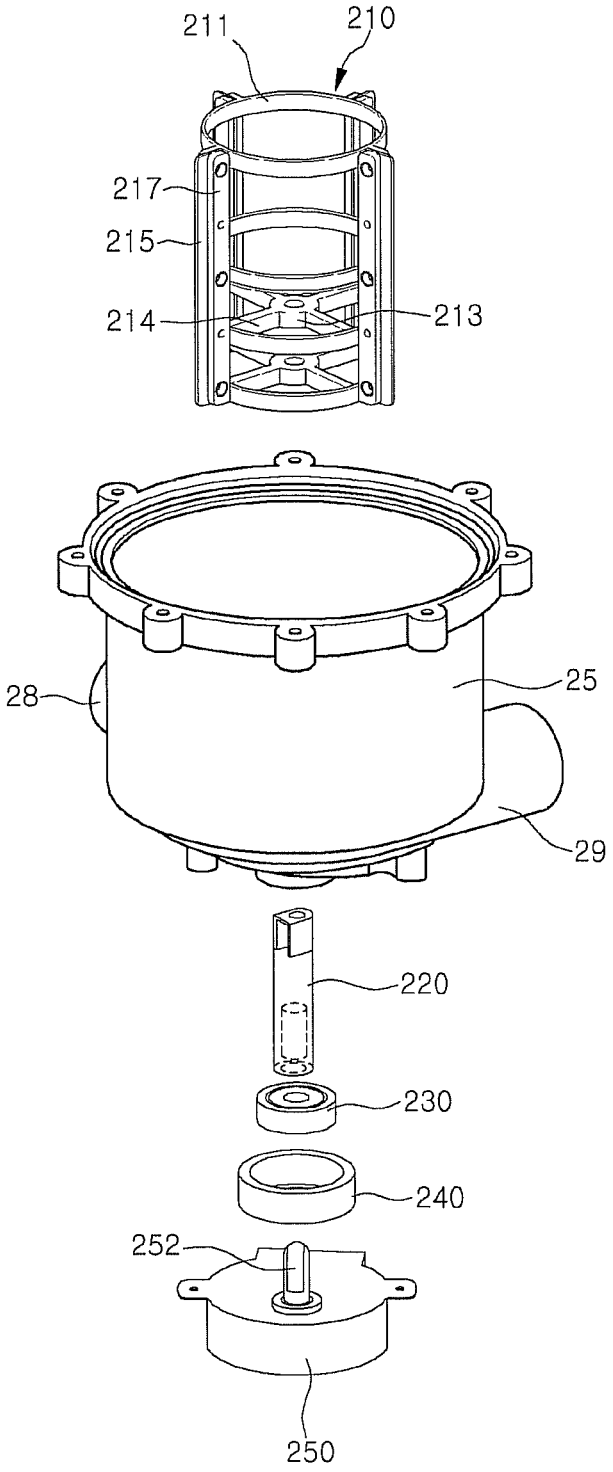
FIG. 6 is an exploded perspective view showing a mounting structure of the clean unit according to the first exemplary embodiment of the present invention.
Figure 7:
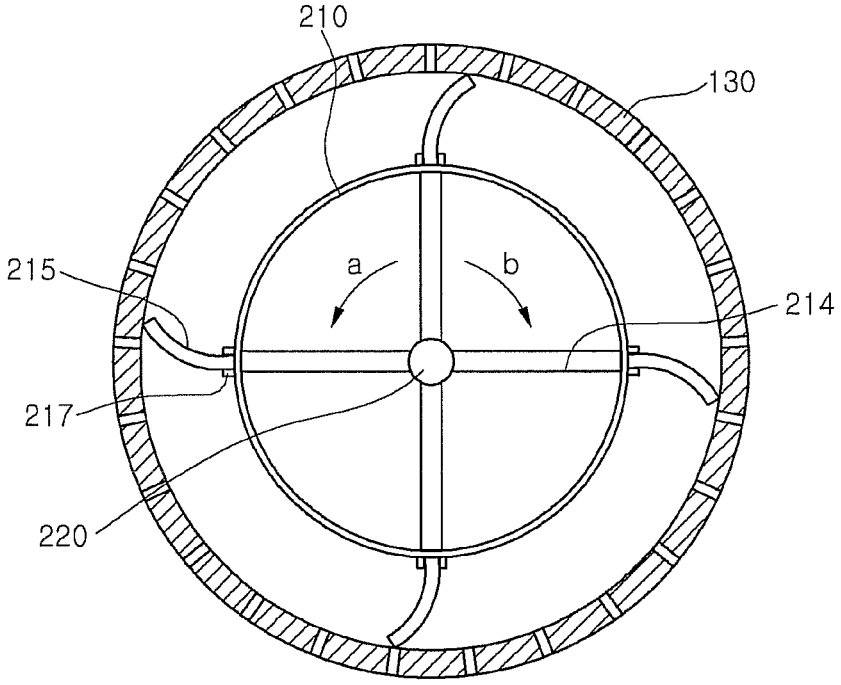
FIG. 7 is a view showing operation of the clean unit according to the first exemplary embodiment of the present invention.

FIG. 5 is an exploded perspective view showing configurations of a filter device and a cleaning unit according to the first exemplary embodiment of the present invention, FIG. 6 is an exploded perspective view showing configurations of a filter device and a cleaning unit according to the first exemplary embodiment of the present invention, and FIG. 7 is a view showing operation of the clean unit according to the first exemplary embodiment of the present invention.

Referring to FIGS. 5 to 7, the filter device 110 and 130 according to the first exemplary embodiment of the present invention includes the first filter 110 and the second filter 130, as described above. The second filter 130 is disposed downstream of the first filter 110.

More specifically, the first filter 110 includes a filter main body 111 forming an outer appearance thereof and a seat part 115 extending along an outer peripheral surface and allowing the first filter 110 to be seated on the sump cover 22. The seat part 115 may be seated on an upper side of the pre filter 50. The second filter 110 is received in the inner portion of the second filter 130.

In addition, one or more first through holes 112 filtering foreign substances from the washing water is formed in the filter main body 111.

One or more second through holes 132 filtering foreign substances from the washing water is formed in the second filter 130. The second through hole 132 has a size larger than that of the first through hole 112. The cleaning unit 200 may be disposed between the first filter 110 and the second filter 130 and may contact the inner surface of the second filter 130. During a process in which the cleaning unit 200 moves, the second filter 130 may be cleaned away.

More specifically, the cleaning unit 200 includes an operating member 210 which is movable and a motor 250 providing a driving force to the operation member 210.

The operating member 210 may be received in a space between the first filter 110 and the second filter 130. That is, the operating member 210 is disposed downstream of the first filter 110 and upstream of the second filter 120. The operating member is provided at the outer side of the first filter 110, and at least a portion of the operating member may be disposed at the inner side of the second filter 130.

The operating member 210 includes a frame 211 forming outer appearance thereof, cleaning elements 215 provided at an outer side of the frame 211 to contact the second filter 130, and a cleaning element fixing part 217 fixing the cleaning elements 215 to the frame 211.

The frame 211 may be disposed so that a plurality of members having a ring shape are spaced apart in a vertical direction, and thus the entire shape thereof may be a cylindrical shape.

The cleaning elements 215 may be provides in a length direction of the frame 211, and a plurality of cleaning elements 215 may be coupled to the outer side of the frame 211 at the approximately same interval. In addition, the vertical height of the cleaning elements 215 may approximately correspond to that of the second filter 130.

The cleaning elements 215, for example, 4 cleaning elements may be provided along the outer peripheral surface of the operating member 210 at the approximately same interval. In this case, each of the plurality of cleaning elements 215 may be disposed so as to be separated from the adjacent ones by 90 degrees based on the center of the operating member 210.

Alternatively, two or three cleaning elements 215 may be provided. Of course, five or more cleaning elements may be provided. That is, according to the present invention, one or more cleaning elements may be included in the operating member.

In the state in which the cleaning elements 215 are coupled to the cleaning element fixing part 217, at least a portion of the cleaning elements may be disposed to protrude outside of the cleaning element fixing part 217. Here, the protruded portion of the cleaning elements 215 may contact the second filter 130.

In addition, the cleaning elements 215 may be made of rubber or plastic. Furthermore, the cleaning elements 215 may be made of a material that is deformable in a predetermined direction. Therefore, when the operating member 210 is rotated in the state in which the cleaning elements 215 contact the second filter 130, the cleaning elements 215 may be deformable in a predetermined direction.

Meanwhile, the motor 250 providing the driving force to rotate the operating member 210 and a rotation shaft 220 transmitting the driving force of the motor 250 to the operating member 210 are provided at the lower portion of the filter housing 25.

A motor shaft 252 coupled to the rotation shaft 220 is provided on the motor 250. A shaft housing receiving the rotation shaft 220 and a sealing part 230 provided in the shaft housing 240 to support the rotation axis 220 are provided at the outer side of the rotation shaft 220.

The rotation shaft 220 coupled the rotation motor 250 passes through a bottom surface of the filter housing 25 to be coupled to the operating member 210.

The operating member 210 a shaft coupling part 213 to which the rotation shaft 220 is coupled and a reinforcing rib 214 extending from the shaft coupling part 213 to the frame 211 to reinforce a strength of the shaft coupling part 213.

The shaft coupling part 213 may have a hollow shape so that the rotation shaft is coupled thereto, and the reinforcing rib 214 may radially extend from the shaft coupling part 213.

Hereafter, an operation of the cleaning unit 200 according to the first exemplary embodiment of the present invention will be described.

The motor 250 may be a bi-directional motor providing a rotation force in both directions. Therefore, when power is applied to the motor 250, the rotation shaft 220 may be rotated in an "a" direction or "b" direction. As a result, the operating member 210 may be rotated in the same direction as that of the rotation shaft 220. Here, the motor 250 may be controlled so as to be rotated in the "a" or "b" direction according to a predetermined period.

For example, the operating member 210 may be rotated at a 2.5 rpm speed. That is, the operating member 210 may be rotated at 2.5 revolutions a minute. Here, when the operating member 210 is rotated for six seconds, an amount of rotation thereof is a quarter of a revolution (it is rotated by 90 degrees).

Meanwhile, as shown in FIG. 6, in the case in which four cleaning elements are provided, when the operating member 210 is rotated by a quarter of a revolution a cleaning element 215 may be rotated by 90 degrees, thereby moving to the position of an adjacent other cleaning element 215.

In this process, the cleaning elements 215 scrape the entire area of the second filter 130 once. That is, the entire area of the inner peripheral surface of the second filter 130 may be once cleaned by a plurality of cleaning elements 215.

On the other hand, in the case in which two cleaning elements 215 are provided at a 180-degree interval, when the operating member 210 is rotated for 12 seconds the entire area of the second filter 130 may be cleaned.

In short, according to how many cleaning elements 215 are provided, time when the operating member 210 is rotated may be varied, and the rotation time of the operating member may be preset. That is, in the case in which four cleaning elements 215 are provided, the rotation time of the operating member 210 may be preset to 6 seconds, or in the case in which two cleaning elements 215 are provided, the rotation time of the operating member 210 may be preset to 12 seconds.

When the operating member 210 is rotated, the cleaning elements 215 may be rotated in a clockwise or counterclockwise direction as it contacts the inner peripheral surface of the second filter 130. As described above, in the process in which the cleaning elements 215 scrape the second filter 130, foreign substances inserted in the second filter 130 may be separated from the second filter 130.

Therefore, since the second filter 130 is prevented from being clogged by foreign substances, flow of the washing water may be smooth.

Figure 8:
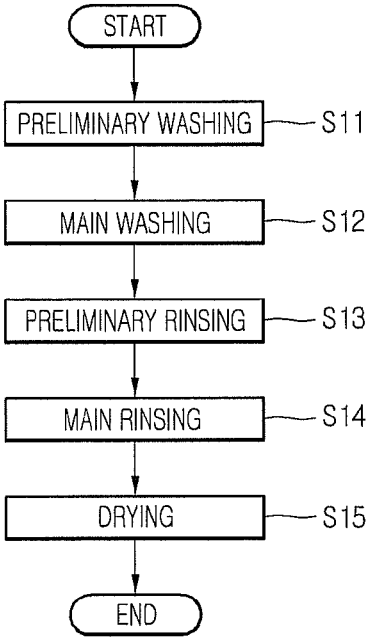
FIG. 8 is a flow chart showing steps of the dishwasher according to the first exemplary embodiment of the present invention.
Figure 9:
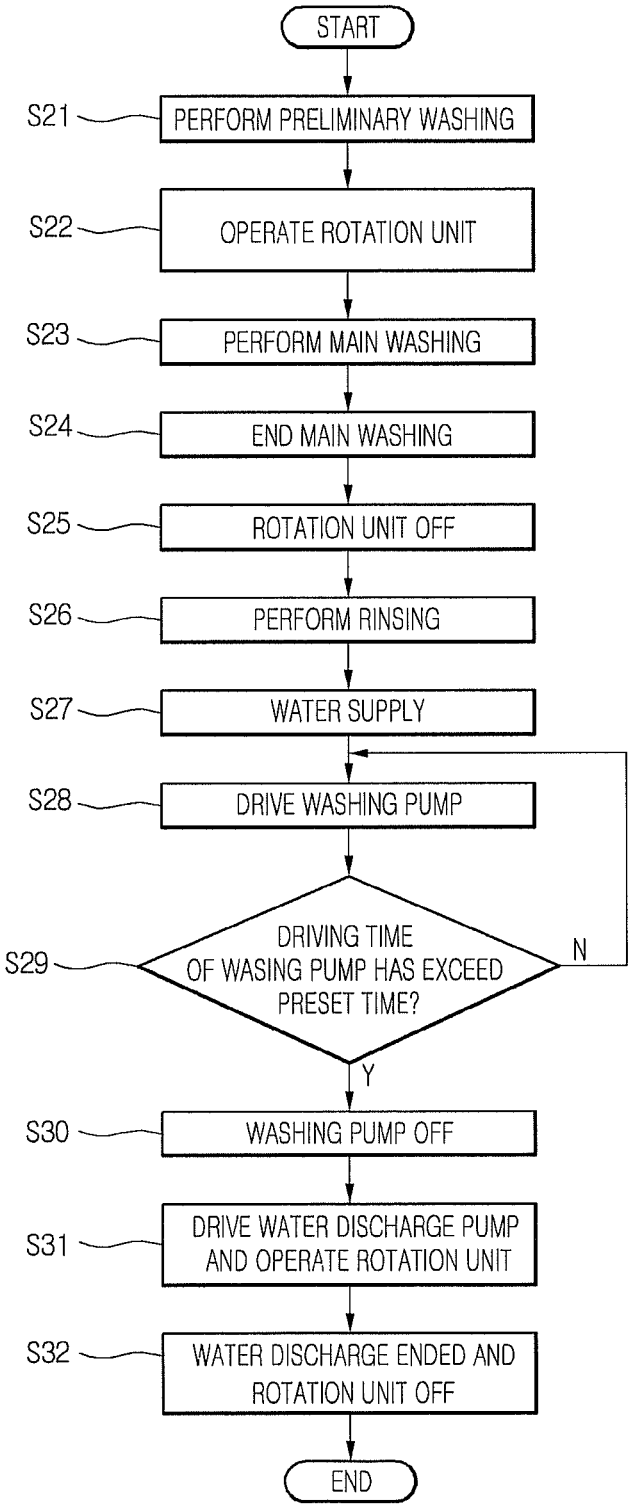
FIG. 9 is a flow chart showing a control method of the dishwasher according to the first exemplary embodiment of the present invention.

FIG. 8 is a flow chart showing steps of the dishwasher according to the first exemplary embodiment of the present invention, and FIG. 9 is a flow chart showing a control method of the dishwasher according to the first exemplary embodiment of the present invention.

Referring to FIGS. 8 and 9, a driving step of the dishwasher 1 according to the first exemplary embodiment of the present invention includes preliminary washing S11, main washing S12, preliminary rinsing S13, main rinsing S14, and drying S15.

A step including the preliminary washing and the main washing may be referred to as a "washing step", and a step including the preliminary rinsing and the main rinsing may be referred to as a "rinsing step".

In the preliminary washing S11, in which garbage, largely composed of protein, is removed with washing water that is not heated but is at room temperature, water supply, washing, and water discharge may be performed.

In the main washing S12, in which a washing detergent is used and foreign substances are removed by heating the washing water by the heater 68, water supply, washing, and water discharge may be performed In the washing process, a process in which the washing water is introduced into the sump and filtered and then is introduced into the space for washing may be repeated several times.

In the preliminary rinsing S13, in which washing water is supplied to perform preliminary rinsing, foreign substances, the washing detergent, or the like, which adhere to dishes are cleaned away after cleaning the washing step S11 and S12.

After completing preliminary rinsing in the preliminary rinsing S13, the used washing water is discharged and again washing water is supplied, thereby making it possible to perform the main rinsing S14.

In the main rinsing S14, the rinsing is performed using a rinse aid. In the main rinsing S14, a process in which the washing water is introduced into the sump and filtered and then is introduced into the space for washing may be repeated several times. After rinsing dishes in the main rinsing S14, the washing water used to rinse dishes may be discharged.

When the rinsing step S13 and S14 is ended, the drying removing remaining wetness may be performed.

Meanwhile, in the process of performing the cleaning step, while foreign substances that have adhered to the dishes are being removed, a large amount of foreign substances may be collected in the filter device 110 and 130. Therefore, possibility in which the filter device 110 and 130 are clogged by the foreign substances is increased.

On the other hand, in the process of performing the cleaning step, while remaining foreign substances and the washing detergent on the dishes are being removed, a relatively small amount of foreign substances may be collected in the filter device 110 and 130. Therefore, the possibility that the filter device 110 and 130 are clogged by foreign substances may be lower in the rinsing step than in the washing step.

Therefore, the cleaning unit 200 may be operated during a long period of time in the washing step and may be operated during a relatively short period of time in the rinsing step. That is, the cleaning time in which the second filter 130 performs cleaning in the washing step may be set longer than that in the rinsing step. Alternatively, the operating speed (for example, rotation speed) may be faster than that of the cleaning unit in the rinsing step.

Hereinafter, a method of controlling the dishwasher described above will be described.

Referring to FIG. 9, a preliminary washing is performed on dishes accommodated in a space for washing S21. In the preliminary washing, the cleaning unit 200 is operated and the cleaning elements 215 perform cleaning on the second filter 130 during operation of the cleaning unit 200.

When the preliminary washing is ended, a main washing is performed. After a preset time has elapsed, the main washing may be ended S24. When the main washing is ended, operation of the cleansing unit 200 turns OFF. Therefore, the cleaning of the cleaning elements 215 is stopped S25.

That is, the cleaning unit 200 continuously (sequentially) operates (performs the cleaning) during the washing step, that is, the preliminary washing and main washing process.

Since a large amount of foreign substances may be introduced into the filter device 110 and 130 during the washing step such that the contamination of the second filter 130 may increases, the cleaning unit 200 may continuously operates during the washing step to perform the cleaning of the second filter 130.

In the state in which the operation of the cleaning unit 200 is OFF, the rinsing step, that is the preliminary rinsing and main rinsing may be performed (S26). When the rinsing step is performed water is supplied S27 and the washing pump 70 is driven S28.

Whether the driving time of the washing pump 70 has exceeded the preset time is determined S29. Here, the preset time may correspond to each rinsing time of the preliminary rinsing and main rinsing.

When the driving time of the washing pump 70 has exceeded the preset time, the operation of the washing pump 70 becomes OFF. When the driving time of the washing pump 70 has not exceeded the preset time, the process returns back to S28 (S30).

When the operation of the washing pump 70 is OFF, the water discharge pump 90 is driven. When the water discharge pump 90 is driven, the washing water used in the rinsing step is discharged. In addition, the cleaning unit 200 operates to perform cleaning on the second filter 130.

When the motor 250 is driven and the water discharge pump 90 is driven in the state in which foreign substances are separated from the second filter 130 by the cleaning elements 215, the foreign substances may be easily discharged together with the washing water through the water discharge part 29.

In short, in each of water discharging processes performed in the preliminary rinsing and main rinsing, the cleaning unit 200 operates to perform cleaning on the second filter 130. Since contamination by foreign substances within the filter is relatively small in the rinsing step, cleaning may be controlled to be intermittently performed on the filter only in the water discharging process in which foreign substances are discharged.

In this case, the period of time when the cleaning is performed on the second filter 130 in the rinsing step may be set shorter than that in the washing step.

According to the method described above, power consumption may be reduced.

When water discharging is ended the operation of the cleaning unit 200 is OFF, and the rinsing step may be ended S32. After the rinsing step is ended, the drying step may be performed.

Hereinafter, a second exemplary embodiment of the present invention will be described. As compared to the first exemplary embodiment, a difference between the two exemplary embodiments is generated in the control method. Therefore, the second exemplary embodiment of the present invention will be described based on the difference.

Figure 10:
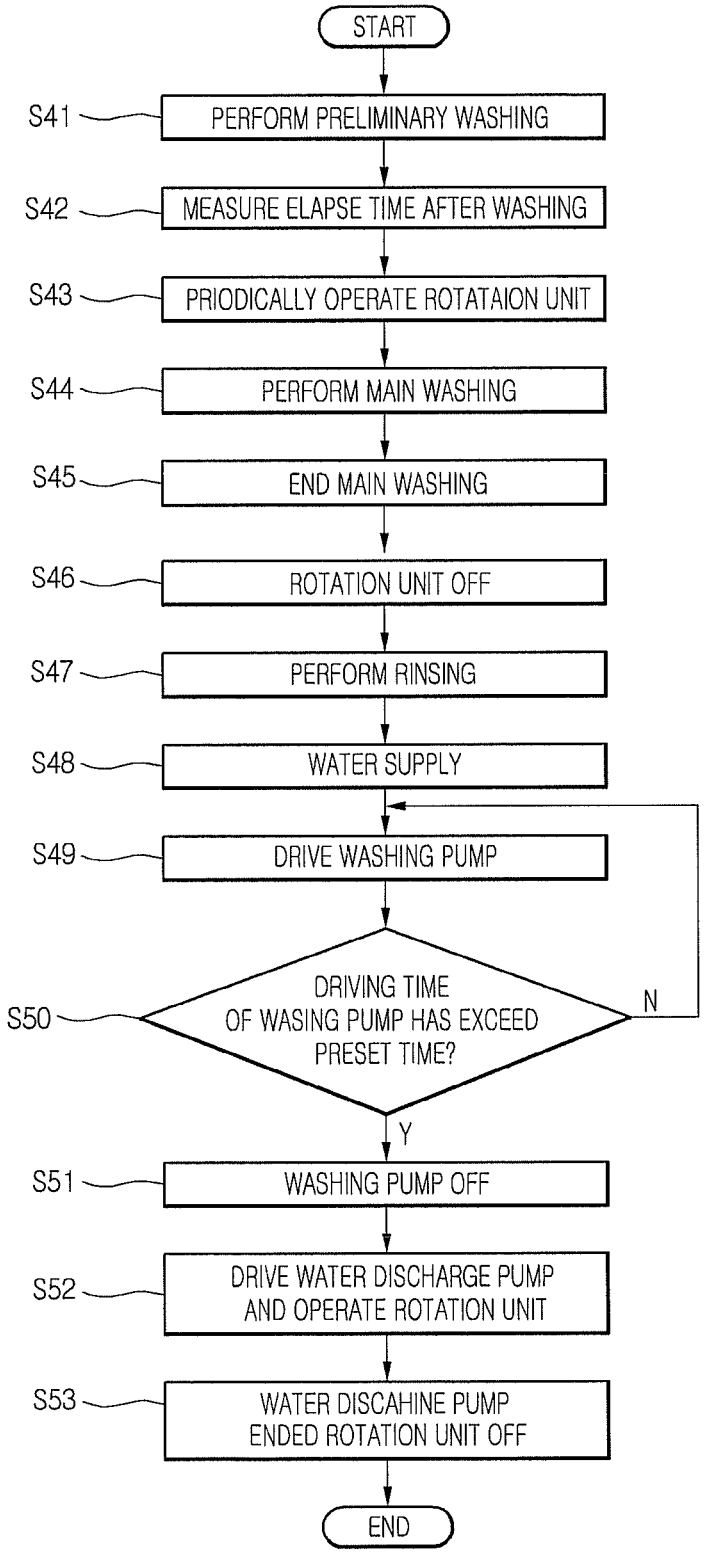
FIG. 10 is a flow chart showing a control method of a dishwasher according to a second exemplary embodiment of the present invention.

FIG. 10 is a flow chart showing a control method of a dishwasher according to a second exemplary embodiment of the present invention.

Referring to FIG. 10, a preliminary washing is performed on dishes accommodated in a space for washing S41. Elapsed time since start time of the preliminary washing is measured S42.

In the preliminary washing, the cleaning unit 200 is operated and the cleaning elements 215 perform cleaning on the second filter 130 during operation of the cleaning unit 200. Here, the cleaning unit 200 may operate according to the predetermined period.

For example, the cleaning unit 200 may operate for six seconds on a cycle of thirty seconds during which the preliminary washing is performed. Here, the "six seconds" may be defined as the time when the cleaning unit 200 including 4 cleaning elements 215 is rotated by 90 degrees.

Here, in the process that the cleaning unit 200 is rotated, the entire inner peripheral surface of the second filter 130 may be cleaned once. That is, the cleaning elements 215 may scrape the entire inner peripheral surface of the second filter 130 once.

If the preliminary washing is performed for two minutes, the cleaning unit 200 operates for 24 seconds in the preliminary washing process and the entire inner peripheral surface of the second filter 130 may be scraped four times. That is, cleansing of the second filter 130 may be performed four times.

Of course, the "six seconds" is the time set based on four cleaning elements 215 by way of example. In the case of two cleaning elements 215, the time may be set to "12 seconds".

In addition, operation time of six seconds of the cleaning unit 200 for 30 seconds of the preliminary washing process is provided as an example. Therefore, the operation time may be set to six seconds for one minute of the preliminary washing process, alternatively.

The preliminary washing is ended, and the main washing is performed. The main washing is performed during the preset time and is ended when the preset time elapses. Even while the main washing is being performed, the cleaning unit 200 may be performed during the preset time, that is, operation time of six seconds on a cycle of 30 seconds S44 and S45.

When the main washing is ended, the operation of the cleaning unit 200 becomes OFF S46.

In the state in which the operation of the cleaning unit 200 is OFF, the rinsing step, that is the preliminary rinsing and main rinsing may be performed S47. When the rinsing step is performed water is supplied S48 and the washing pump is driven S49.

Whether the driving time of the washing pump 70 has exceeded the preset time is determined. Here, the preset time may correspond to each rinsing time of the preliminary rinsing and main rinsing S50.

When the driving time of the washing pump 70 has exceeded the preset time, the operation of the washing pump 70 becomes OFF. When the driving time of the washing pump 70 has not exceeded the preset time, the process returns back to S49 (S51).

When the operation of the washing pump 70 is OFF, the water discharge pump 90 is driven. When the water discharge pump 90 is driven, the washing water used in the rinsing step is discharged. In addition, the cleaning unit 200 operates to perform cleaning on the second filter 130.

When the motor 250 is driven and the water discharge pump 90 is driven in the state in which foreign substances are separated from the second filter 130 by the cleaning elements 215, the foreign substances may be easily discharged together with the washing water through the water discharge part 29.

In short, in each of water discharging processes performed in the preliminary rinsing and main rinsing, the cleaning unit 200 operates to perform cleaning on the second filter 130. Since contamination by foreign substances within the filter is relatively small in the rinsing step, cleaning may be controlled to be performed on the filter only in the water discharging process in which the washing water is discharged S52.

When water discharging is ended the operation of the cleaning unit 200 is OFF, and the rinsing step may be ended S53. After the rinsing step is ended, the drying step may be performed.

Although the two exemplary embodiments of the present invention have been described in the case in which the cleaning unit operates in the preliminary washing and main washing, the cleaning unit may operates in only one of the washing and main washing.

Figure 11:
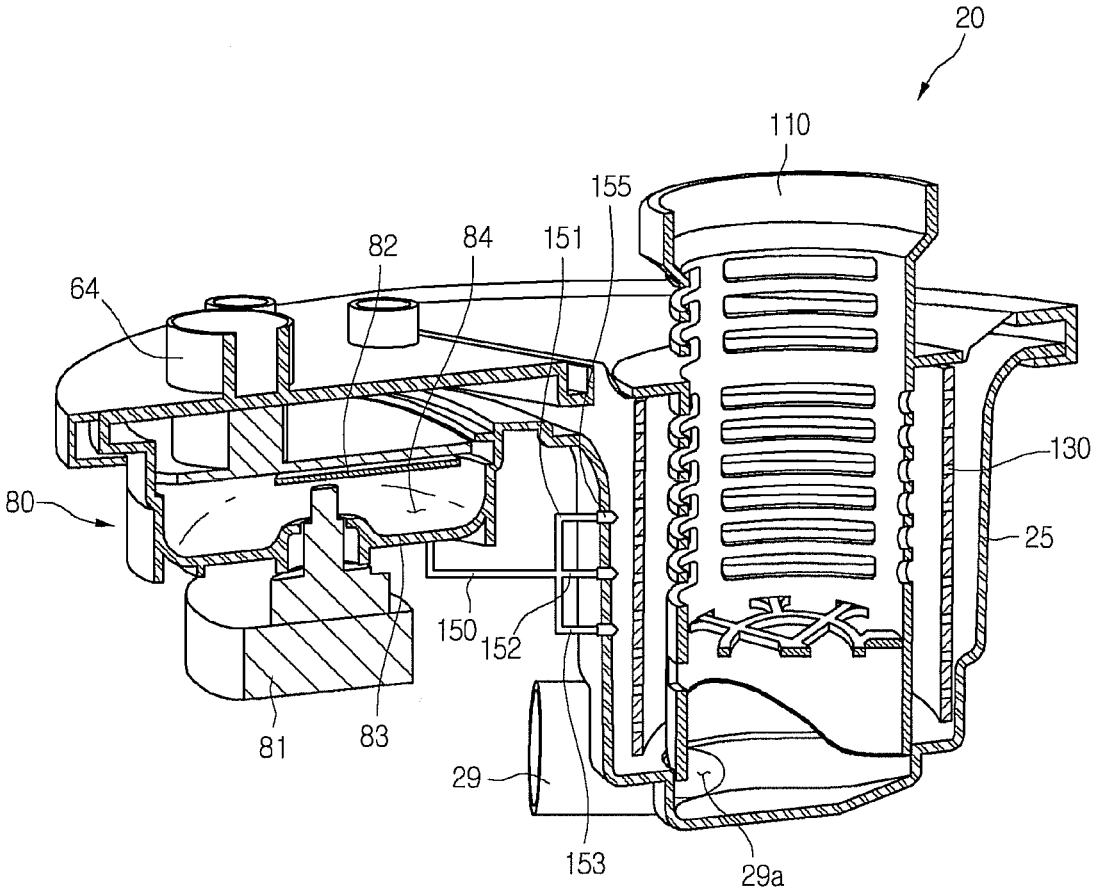
FIGS. 11 and 12 are cross sectional views a configuration of a sump according to a third exemplary embodiment of the present invention.
Figure 12:
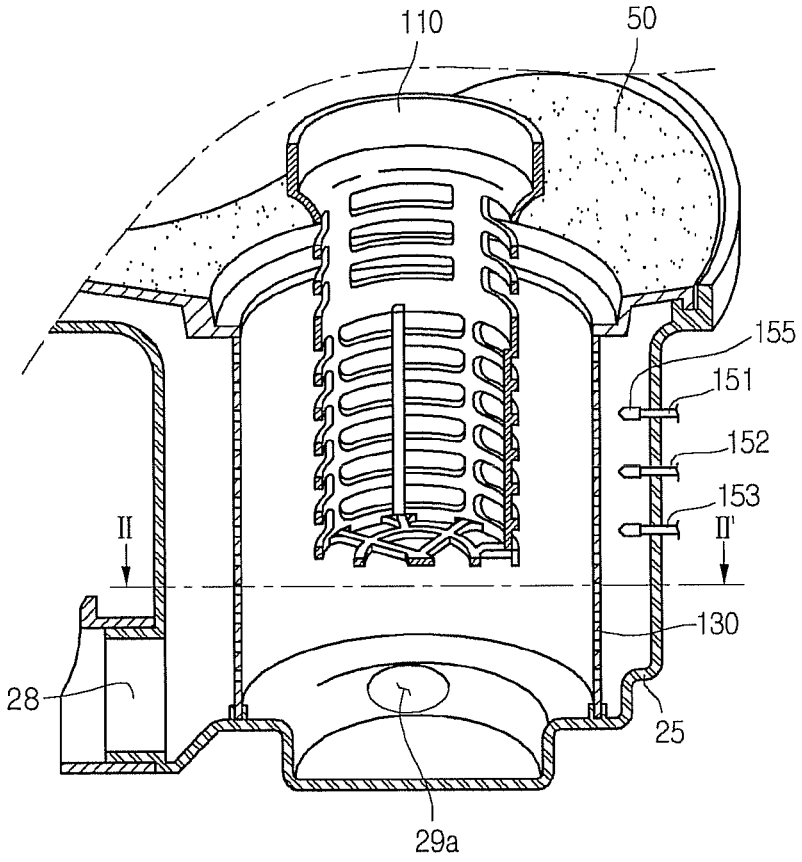
Figure 13:
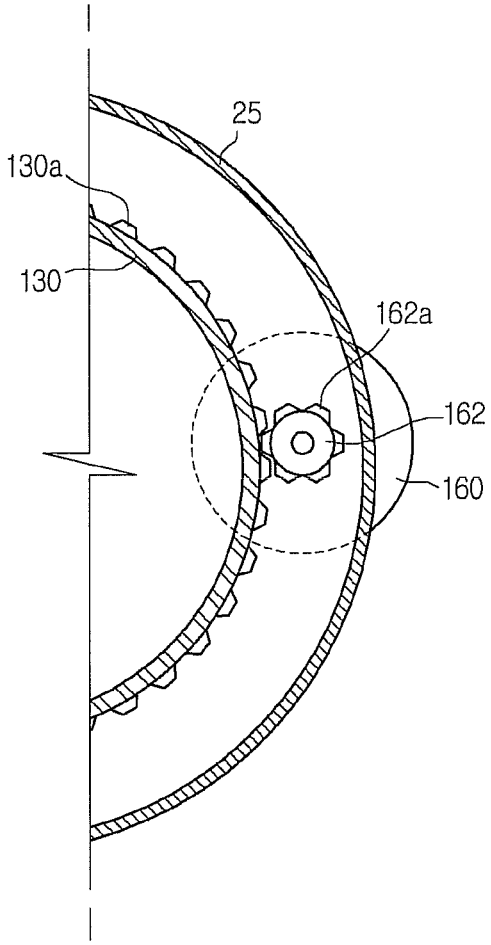
FIG. 13 is a cross sectional view taken along II-II' shown in FIG. 12.

FIGS. 11 and 12 are cross sectional views a configuration of a sump according to a third exemplary embodiment of the present invention, and FIG. 13 is a cross sectional view taken along II-II' shown in FIG. 12.

Referring to FIGS. 11 to 13, a sump 20 according to a third exemplary embodiment of the present invention includes a flow path controlling part 80 controlling a flow path along with washing water moves.

The flow path controlling part 80 includes a control valve 82 controlling the flow path of the washing water, a valve drive part 81 driving the control valve 82, and a case 83 in which the washing water introduced through the washing pump 70 is stored. The case 83 defines a washing water storage part 84 storing the washing water.

A branched flow path 150 is provided at a side of the case 83 so that at least some of the washing water stored in the washing water storage part 84 flows towards the filter device 110 and 130. Here, the flow path of the washing water extended to the filter device 110 and 130, the washing pump 70, the flow path controlling part 80, and a lower nozzle coupling part 19 or a guide coupling part 64 is referred to as a "main flow path".

The first, second, the third branched parts 151, 152, and 153 into which the branched flow path 150 is branched are provided at a side of the branched flow path 150. The washing water flowing through the branched flow path 150 may be branched into the first, second, and third branched parts 151, 152, and 153 and flow along the three branched parts.

Each nozzle part 155 spraying the washing water towards the filter device 110 and 130 is coupled to each of the first, second, and third branched parts 151, 152, and 153. The nozzle parts 155 may be disposed so as to be inserted into the filter housing 25.

The plurality of nozzle parts 155 may be inserted into the filter housing, each with a different height, and as a result, the washing water sprayed from the nozzle parts 155 may act evenly on the filter device 110 and 130. That is, the nozzle parts 155 may be spaced apart in the vertical direction.

Foreign substances accumulated in the filter device may be separated from the filter device 110 and 130 by spraying washing water to the filter device 110 and 130.

Meanwhile, the branched flow path 150 may be selectively opened. That is, in the process in which the dishwasher 1 washes or rinses dishes, the branched flow path 150 may be opened at a preset time. To this end, a valve member (not shown) opening/closing the branched flow path 150 may be provided. Of course, the valve member may not be provided, and in this case cleaning may be performed on the filter device by the washing water flowing along the branched flow path while the washing pump is operating.

When the branched flow path 150 is opened, the washing water may be sprayed to the filter device 110 and 130 through the nozzle parts 155.

However, in order to selectively spray the washing water, the nozzle parts 155 may be opened, instead of opening of the branched flow path 150.

In addition, a "driving unit" and a "power transmitting unit" for rotating the second filter 130 may be provided in the sump 20.

More specifically, the driving unit includes a filter driving unit 160 allowing the second filter 130 to be rotated. The filter driving unit 160 may be provided at a lower portion of the filter housing 25, and may be a motor, by way of example.

The power transmitting unit may include a driving gear 162 rotatably coupled to the filter driving unit 160. The driving gear 162 is provided at an upper portion of the filter driving unit 160 and may be inter-locked to the second filter 130.

Although not shown in drawings, the motor shaft connecting the filter driving unit 160 to the driving gear 162 may extend upwardly while penetrating through the filter housing 25.

First gear teeth 130*a* to be inter-locked to the first driving gear 162 are formed at an outer peripheral surface of the second filter 130, and second gear teeth 162*a* that are coupled to the first gear teeth 130*a* are formed at an outer peripheral surface of the driving gear 162.

When the filter driving unit 160 is driven, the driving gear 162 is rotated, and as a result, the second filter 130 may be rotated in the opposite direction to that of the driving gear 162.

In the process in which the second filter is rotated, the washing water sprayed through the nozzle parts 155 may act evenly on the entire area of the second filter 130. Foreign substances inserted in the second filter 130 may be easily removed from the action.

The first, second, and third branched parts 151, 152, and 153 and the nozzle parts 155 may be referred to as a cleaning unit for cleaning the filter device (specifically, the second filter).

Figure 14:
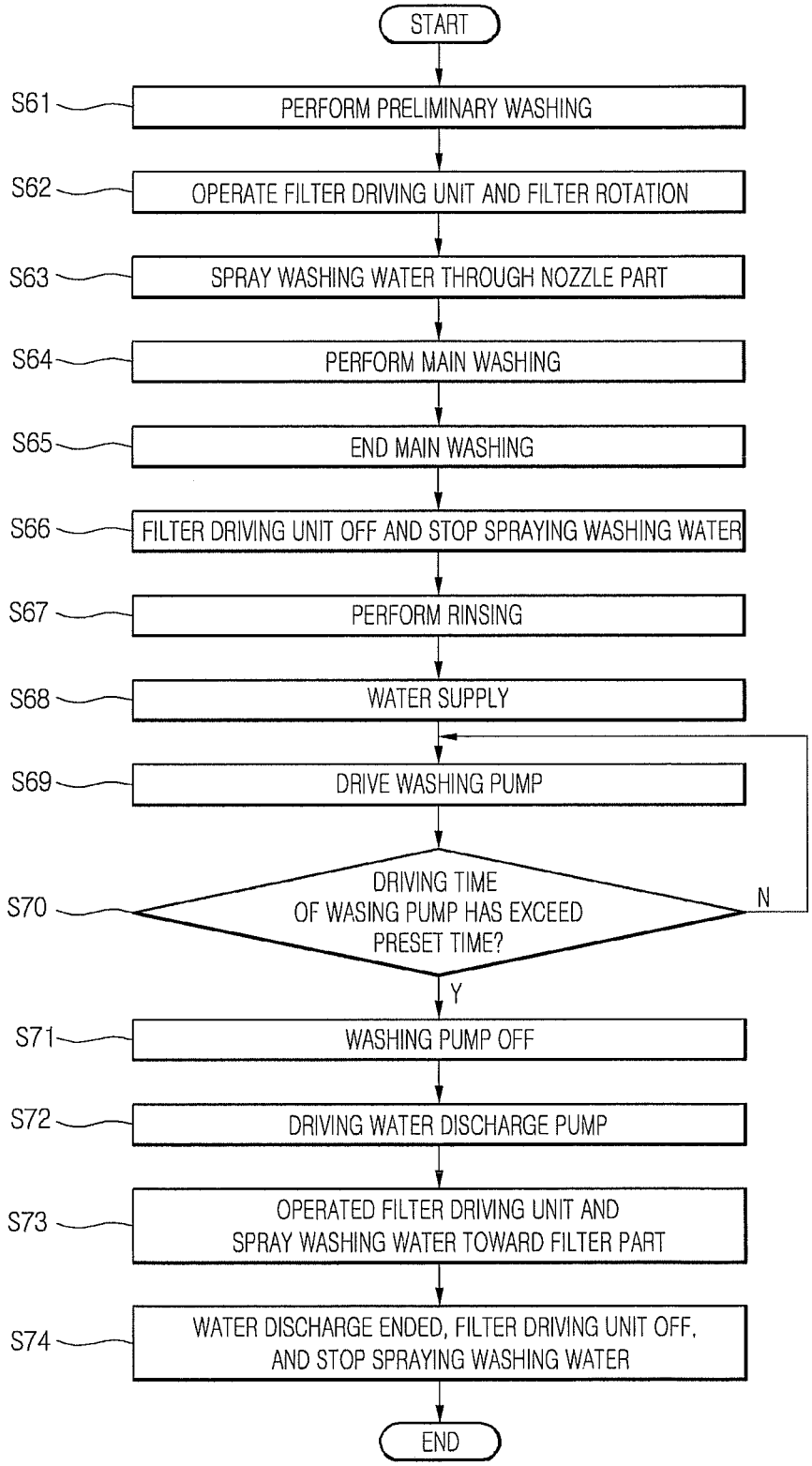
FIG. 14 is a flow chart showing a control method of a dishwasher according to the third exemplary embodiment of the present invention.

FIG. 14 is a flow chart showing a control method of the dishwasher according to the first exemplary embodiment of the present invention.

Referring to FIG. 14, a preliminary washing is performed on dishes accommodated in a space for washing S61. During the preliminary washing, the filer driving unit 160 operates to rotate the second filter 130 S62.

The branched flow path 150 or the nozzle parts 155 may be opened, and the washing water flowing through the branched flow path 150 is sprayed towards the second filter 130. In this process, the second filter 130 may be evenly cleaned S63.

When the preliminary washing is ended, the main washing is performed S64. After a preset time has elapsed, the main washing may be ended S65. When the main washing is ended the operation of the filter driving unit 160 becomes OFF, spray of the washing water through the nozzle parts 155 is stopped S66.

That is, the filter driving unit 160 and the nozzle parts 155 continuously (sequentially) operates (performs cleaning) during the washing step, that is, the preliminary washing and main washing process.

Since a large amount of foreign substances may be introduced into the filter device 110 and 130 during the washing step such that the contamination of the second filter 130 may increases, the filter driving unit 160 and the nozzle parts 155 may continuously operate during the washing step to perform the cleaning of the second filter 130.

In the state in which the operation of the filter driving unit 160 and the nozzle parts 155 are OFF, the rinsing step, that is the preliminary rinsing and main rinsing may be performed S67. When the rinsing step is performed water is supplied S68 and the washing pump 70 is driven S69.

Whether the driving time of the washing pump 70 has exceeded the preset time is determined. Here, the preset time may correspond to each rinsing time of the preliminary rinsing and main rinsing S70.

When the driving time of the washing pump 70 has exceeded the preset time, the operation of the washing pump 70 becomes OFF. When the driving time of the washing pump 70 has not exceeded the preset time, the process returns back to S69 (S71).

When the operation of the washing pump 70 is OFF, the water discharge pump 90 is driven. When the water discharge pump 90 is driven, the washing water used in the rinsing step is discharged. The filter driving unit 160 and the nozzle parts 155 operate and the washing water is sprayed towards the second filter 130, thereby allowing the second filter 130 to be cleaned.

In the state in which foreign substances are separated from the second filter 130 by cleaning of the second filter 130, when the water discharge pump 90 is driven, the foreign substances may be easily discharged together with the washing water through the water discharge part 29.

In short, in each of water discharging processes performed in the preliminary rinsing and main rinsing, the filter driving unit 160 and the nozzle parts 155 operate to perform cleaning on the second filter 130. Since contamination by foreign substances within the filter is relatively small in the rinsing step, cleaning may be controlled to be performed on the filter only in the process in which the washing water is discharged S72 and S73.

When the water discharging is ended, the operation of the filter driving unit 160 becomes OFF, the nozzle parts 155 are closed, and the spray of the washing water is stopped. Therefore, the rinsing step may be ended S74. After the rinsing step is ended, the drying step may be performed.

Hereinafter, a fourth exemplary embodiment of the present invention will be described. As compared to the first exemplary embodiment, a difference between the first exemplary embodiment and the fourth exemplary embodiment is generated in the cleaning unit. Therefore, the fourth exemplary embodiment of the present invention will be described based on the difference, and the same reference numerals will be used to describe the same components.

Figure 15:
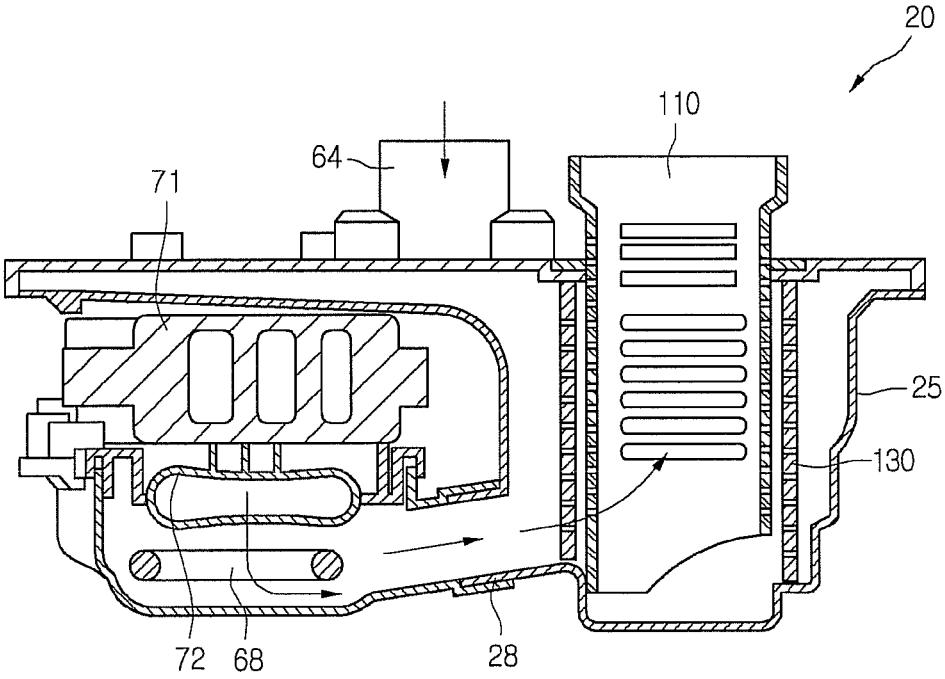
FIG. 15 is a cross-sectional view showing a configuration of a sump according to a fourth exemplary embodiment of the present invention.
Figure 16:
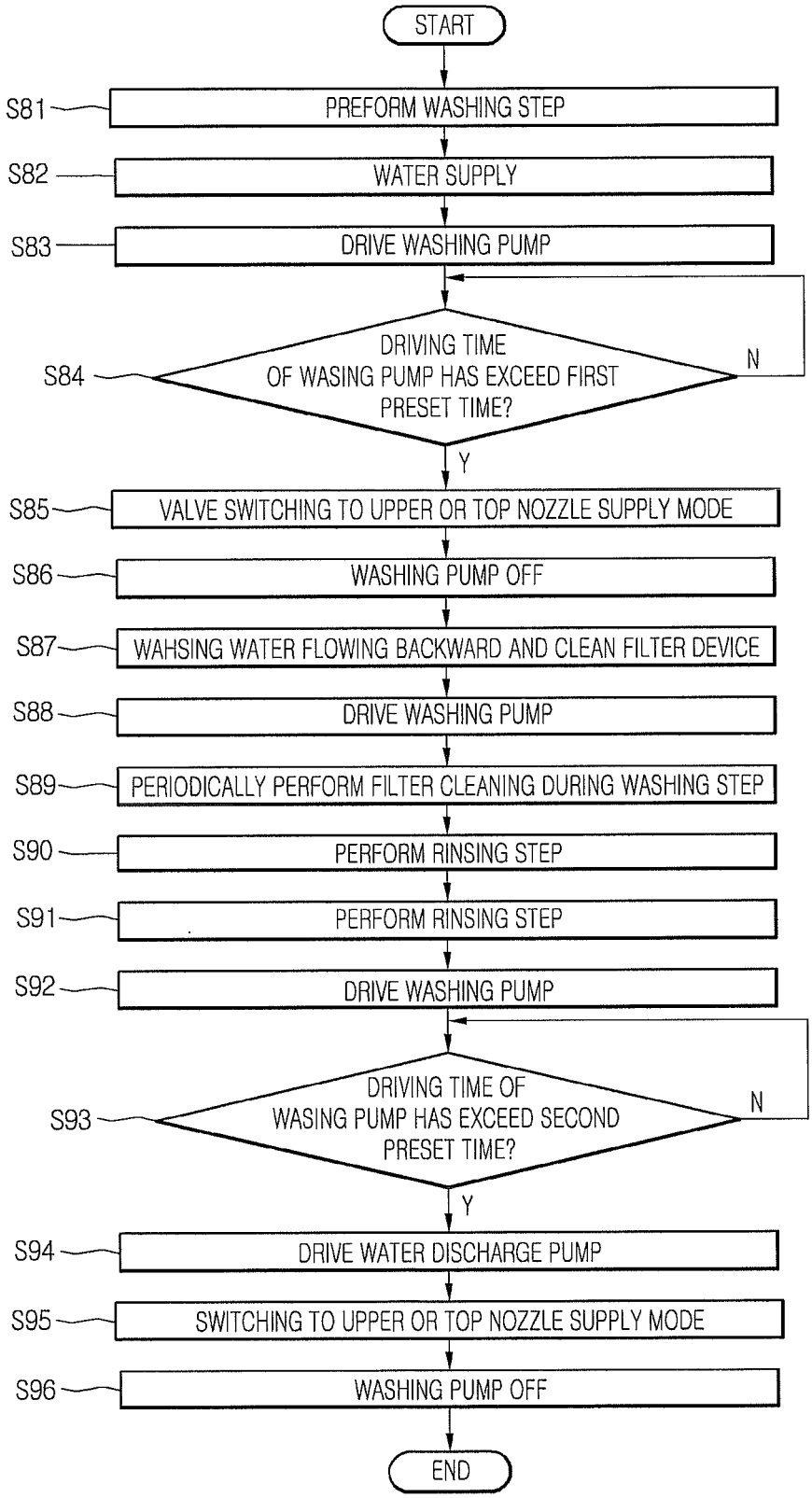
FIG. 16 is a flow chart showing a control method of a dishwasher according to the fourth exemplary embodiment of the present invention.

FIG. 15 is a cross-sectional view showing a configuration of a sump according to a fourth exemplary embodiment of the present invention and FIG. 16 is a flow chart showing a control method of a dishwasher according to the fourth exemplary embodiment of the present invention.

Referring to FIG. 15, a sump 20 according to the fourth exemplary embodiment of the present invention includes first and second filters 110 and 130 accommodated in a filter housing 25, a washing pump 70 supplying washing water stored in the sump 20 into a tub 11, that is a washing motor 71 and an impeller part 72, and a guide coupling part 64 coupling the sump 20 to a washing water guide 40.

The washing water in the sump 20 may be raised to upper and top nozzles 16 and 15 by a pumping force of the washing pump 70.

In the state in which the washing water is raised up to the nozzles 15, 16, when operation of the washing pump 70 becomes OFF, the washing water may flow backward sequentially through the washing water guide 40, the guide coupling part 64, and the washing pump 79 and may be act on the filter device 110 and 130.

The washing water flowing backward clashes against the filter device 110 and 130. Through the clash, the foreign substances that adhere to the filter device 110 and 130 may be separated from the filter device 110 and 130. Hereinafter, a control method according to the fourth exemplary embodiment of the present invention will be described.

Referring to FIG. 16, the control method of the dishwasher according to the fourth exemplary embodiment of the present invention will be described.

A washing step is performed on the dishwasher 1 (S81). Washing water is supplied to the sump 20, and the washing pump 70 is driven. The washing water in the sump 20 may be supplied into the tub 11 by the driving of the washing pump 70 and may be sprayed towards dishes through nozzles 15, 16, and 17.

Here, the time elapsed since driving of the washing pump 70 may be counted. Whether the driving time of the washing pump 70 has exceeded a first preset time is determined. The first preset time may be set corresponding to the time required for the main washing.

When the driving time of the washing pump 70 has exceeded the first preset time, the control valve 82 may be controlled so that the washing water is supplied to the upper nozzle 16 or the top nozzle 15 (upper or top nozzle supply mode). On the other hand, when the driving time of the washing pump 70 has not exceeded the first preset time, the process returns back to S83 (S84 and S85).

In the state of upper or top nozzle supply mode in which the first preset time has elapsed, operation of the washing pump 70 may become OFF (S86).

Here, the washing water rose along the washing water guide 40 by the pumping force may flow downwardly due to self-weight and may be introduces into the sump 20 through the guide coupling part 64 and the washing pump 70.

The washing water introduced into the sump 20 flows to the filter device 110 and 130 through the washing pump 70. In this process, since the washing water hits the first and second filter device 110 and 130 with a strong force, the foreign substances that adhere to the filter device 110 and 130 may be cleaned out (S87).

After cleaning has been performed on the filter device 110 and 130 by the washing water flowing backward, the washing pump 70 is driven again (S88).

After a predetermined time has elapsed, the washing pump 70 becomes OFF again, and the filter device 110 and 130 may be cleaned by clashing against the washing water flowing backward. The above-mentioned filer cleaning may be periodically performed during the washing step (S89).

According to the control method of the fourth exemplary embodiment, since the filter cleaning is periodically performed during the washing step in which a large amount of foreign substances are accumulated in the sump 20, the filter device 110 and 130 may be prevented from being clogged by the foreign substances.

Meanwhile, after the washing step is ended, the rinsing step may be performed (S90). Water is supplied (S91), and the washing pump 70 is driven (S92).

Whether the driving time of the washing pump 70 has exceeded a predetermined time for rinsing, that is a second preset time is determined. When the driving time of the washing pump 70 has not exceeded the second preset time, the process returns back to S92 (S93 and S94).

In the state in which the water discharge pump 90 is driven the control valve is controlled, and the washing water is supplied to the upper or top nozzles by switching to the upper or top nozzle supply modes. Then, the washing pump 70 becomes OFF.

When the washing pump 70 is OFF, the washing water flows backward and clashes against the filter device 110 and 130. Foreign substances separated when the washing water clashes against the filter device 110 and 130 may be discharged to the outside through the water discharge part 29 by the suction force of the water discharge pump 90 (S95 and S96).

In short, in the rinsing step, that is, the preliminary rinsing and main rinsing, the filter cleaning may be performed in the water discharging process due to the clashing force of the washing water.

According to the fourth exemplary embodiment of the present invention, since the washing motor and the washing water guide serve to clean the filter device, they may be referred as to a cleaning unit.

As described above, since the filter device 110 and 130 are relatively less contaminated in the rinsing step, cleaning may be effectively performed on the filters even though the cleaning is performed only in the water discharging process, and power consumption may be reduced.

Although the filter device according to the exemplary embodiments described above includes a plurality of filters, the filter device may include a single filter. In this case, it may be understood that the filter device is rotated by the cleaning unit or rotates by itself.

Also, "the filter device is rotated" means that the whole filter device body or some filters of the filter device is rotated.

What is claimed is:

1. A dishwasher for washing dishes according to washing, rinsing, and drying, comprising:

a tub provided with a rack for accommodating dishes, and a washing nozzle for spraying washing water;

a sump to collect the washing water supplied to the tub;

a filter device provided at the sump, and allowing foreign substances of the washing water to be filtered, wherein the filter device includes a plurality of filters, the plurality of filters including a first filter and a second filter; and a cleaning unit that clears away the foreign substances accumulated in the filter device, wherein the cleaning unit includes an operating member to operate for cleaning the filter device, the operating member having a plurality of cleaning elements contacting the second filter, and a water discharge pump to communicate with the sump, the water discharge pump for generating a suction force to discharge the washing water stored in the sump and foreign substances remaining in the filter device, wherein the operating member is disposed within the second filter, and the first filter is disposed within the operating member, wherein when the washing is performed, the cleaning unit cleans the filter device, wherein when the washing is ended, an operation of the cleaning unit is stopped, and wherein when rinsing is performed, the cleaning unit cleans the filter device only when the water discharge pump is operated.

2. The dishwasher according to claim 1, wherein the operating member comprises:

a frame to form an outer appearance thereof, and a cleaning element fixing part to fix the cleaning elements to the frame.

3. The dishwasher according to claim 2, wherein the frame includes first and second members that are spaced apart from each other in a vertical direction to define a passage through which washing water flowing through the first filter passes.

4. The dishwasher according to claim 1, wherein the cleaning unit includes a motor to rotate the operating member.

5. The dishwasher according to claim 1, wherein the plurality of cleaning elements are spaced apart from one another.

6. The dishwasher according to claim 1, wherein a time to clean the filter device in the rinsing is shorter than a time in the washing.

7. The dishwasher according to claim 1, wherein the cleaning unit intermittently cleans the filter device during the washing.

8. The dishwasher according to claim 1, wherein a cleaning element fixing part includes a plurality of vertical structures, each vertical structure to fix at least one of the plurality of cleaning element to a frame.

* * * * *